US006905725B2

(12) United States Patent
Dykhne et al.

(10) Patent No.: US 6,905,725 B2
(45) Date of Patent: Jun. 14, 2005

(54) METHOD FOR CREATING AND VISUALIZING AN OPTICALLY INVISIBLE MARK

(75) Inventors: Alexander M. Dykhne, Moscow (RU); Yuri K. Nizienko, Moscow Region (RU)

(73) Assignee: Valinmark Inc., Toronto (CA)

( * ) Notice: Subject to any disclaimer, the term of this patent is extended or adjusted under 35 U.S.C. 154(b) by 0 days.

(21) Appl. No.: 10/475,935

(22) PCT Filed: Apr. 26, 2001

(86) PCT No.: PCT/RU01/00177

§ 371 (c)(1),
(2), (4) Date: Oct. 27, 2003

(87) PCT Pub. No.: WO02/089041

PCT Pub. Date: Nov. 7, 2002

(65) Prior Publication Data

US 2004/0126703 A1 Jul. 1, 2004

(51) Int. Cl.[7] ..... B05D 3/06; B05D 5/06

(52) U.S. Cl. ..... 427/7; 427/523; 427/526; 427/569; 427/256; 427/261; 427/335

(58) Field of Search ..... 427/7, 595, 596, 427/523, 526, 569, 261, 256, 335

(56) References Cited

U.S. PATENT DOCUMENTS 5,206,496 A * 4/1993 Clement et al. ..... 250/271
5,767,483 A * 6/1998 Cameron et al. ..... 219/121.85

FOREIGN PATENT DOCUMENTS

| | | | |
|---|---|---|---|
| EP | 0271245 | A2 | 6/1988 |
| RU | 2073270 | C1 | 2/1997 |
| WO | WO 94/06102 | A1 | 3/1994 |
| WO | WO 99/34315 | A2 | 7/1999 |

* cited by examiner

*Primary Examiner*—Kirsten Jolley

(57) ABSTRACT

This invention relates to methods of writing and reading information hidden from visual observation and may be used for visualizing hidden images (marks) identifying an object, which provide protection from unauthorized reproduction (forgery). The method of creation and visualization of an optically invisible mark consists in the following. On the surface of the object in question an optically invisible marking image is formed by means of modification of, at least one part of said surface, after which visualization of said image is established. Prior to formation of the optically invisible marking image the surface of the object in question (carrying the applied image) is made into a mirror. Modification is achieved by changing the surface energy of the parts being modified. In addition the visualization of the optically invisible marking image is achieved by means of establishing in the area of said surface of the object in question a meta-stable environment, by means of which the visually observed image of the optically invisible mark is obtained as differences of the structures, which are formed by particles of the stable phase of the meta-stable environment, on parts of the surface (of the object in question) with different surface energy. Different variants regarding the use of meta-stable environments, as well as methods of formation, on the surface of a object in question, of an optically invisible marking image are provided.

6 Claims, 1 Drawing Sheet

METHOD FOR CREATING AND VISUALIZING AN OPTICALLY INVISIBLE MARK

FIELD OF THE INVENTION

The invention relates to a method for writing and reading visually imperceptible information and can mainly be used for visualization of hidden images (marks) identifying objects, which provide protection against unauthorized reproduction (forgery), but also for purposes of scientific research, for providing visualization of optically invisible structures in the surface layer of an object by variation of surface energy.

PRIOR ART

From the prior art a method is known for creating and visualizing an optically invisible mark, according to which in the near-surface area of the object (in particular, diamond jewelry) an image (protective mark), hidden from perception by the unaided eye is made by means of a laser beam, the further visualization of which may be established by means of corresponding optical means (U.S. Pat. No. 4,467,172).

A disadvantage of the method for visualization of a hidden image known in the art is its limited applicability. For example, when marking jewelry, in particular diamonds, the geometric parameters of the microstructures of the protective mark, which are subjected to visualization by means of optical means, are such, that they are considered defects of the item of jewelry and greatly reduce its aesthetic qualities and its value.

The method closest to the disclosed invention is the method of creation and visualization of an optically invisible mark, according to which in the area of the surface of the object in question an optically invisible marking image is formed by means of modification of at least one part of said surface, after which visualization of the microstructures of the marking image is established, by means of etching and subsequent observation of the mark by means of powerful optical or electronic microscopes (RU No. 2073270, C1).

A disadvantage of said method of creation and visualization of an optically invisible mark known from the prior art, is its limited range of application due to its applicability exclusively for special polymeric materials in the form of films, and to its inability to provide visualization of a marking image without using strong microscopes.

Apart from that, the known method does not allow the mark to be kept optically invisible after its first visualization (i.e. reproduction by use of etching).

DESCRIPTION OF THE INVENTION

The object of the disclosed invention is the creation on the surface of the object in question of a lasting optically invisible mark (i.e. invisible for use with any optical microscope) allowing the temporary, and, in addition, repeated visualization, including visualization without use of optical means.

This aim is achieved in that, in the method of creation and visualization of an optically invisible mark, according to which on the surface of the object in question an optically invisible marking image is formed by modification of, at least, one part of the surface, after which visualization of said image is established, according to the invention, said surface of the object in question is preliminarily brought to a mirror, the modification is made by changing the surface energy of the modified parts, and visualization of the optically invisible marking image is provided by means of creation, in the area of the surface of the object in question, of a meta-stable environment by means of which the visually perceived image of the optically invisible mark is obtained in the form of difference of the structures formed by particles of the stable phase of the meta-stable environment on parts of the surface with different surface energy.

As a meta-stable environment super-cooled vapor may be used, an image of structures being obtained, which structures are formed by particles of the stable phase of the meta-stable environment, in the form of drops of liquid on the surface of the object in question.

A meta-stable environment can conveniently be obtained from the water vapor in the surrounding air, for example by cooling the object in question.

As a meta-stable environment super-heated liquid may be used, an image of structures being obtained, which structures are formed by particles of the stable phase of the meta-stable environment, in the form of gas bubbles on the surface of the object in question.

It would be useful to make the surface of the object in question into a mirror by polishing.

The optically invisible marking image may be formed by a spatially modulated ion beam.

BRIEF DESCRIPTION OF THE DRAWINGS

The invention is further elucidated in the drawings.

PREFERRED EMBODIMENT

Figure 1:
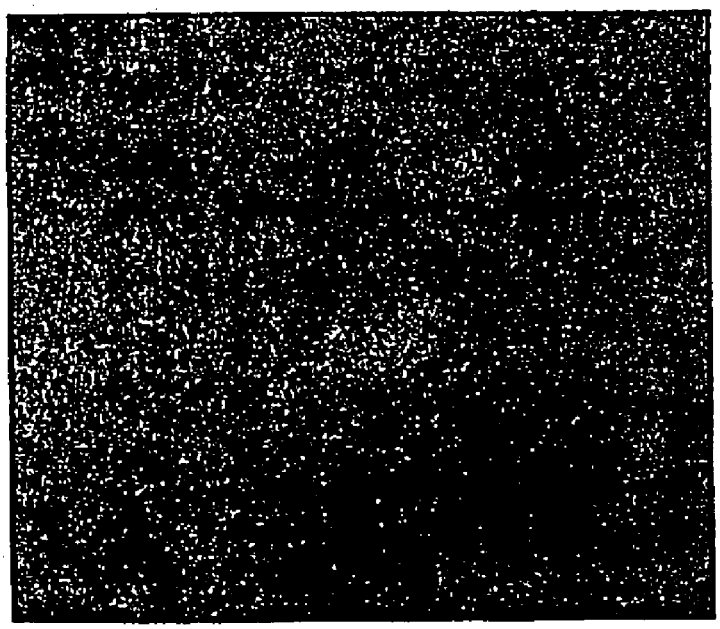
FIG. 1 shows the object in question with an optically invisible marking image before its visualization.

From a physical point of view the disclosed method of creation and visualization of an optically invisible mark (of a hidden image) is essentially based on similar principles regarding visualization of the tracks of charged particles during study thereof by means of a Wilson chamber or a bubble chamber, namely:

condensation of supersaturated vapor on "nucleation centers" (ions) of the stabilized phase state, which (in a Wilson chamber) are ions, that are formed along the path of motion of a charged particle;

boiling up of superheated liquid near "nucleation centers" of boiling (in a bubble chamber), which are formed as a result of heating a small area of liquid due to absorption therein of δ-electrons, which are emitted/released by the charged particle in the course of its movement.

However, the disclosed method is realized by the following, practically different, method.

On the surface of the object in question (preliminarily made into a mirror, for example, by polishing) an optically invisible (hidden) marking image is formed by means of modification of, at least, one part of said surface. The modification is brought about by changing the surface energy of the parts being modified. The modified parts can be obtained, for example, by means of subjecting the corresponding surface of the object in question to a spatially modulated ion beam (for example, by passing an ion beam through a stencil mask) or by means of laser ablation. Visualization of the optically invisible (hidden) image is achieved by establishing in the area of said surface (carrying the optically invisible marking image) of the object in question a meta-stable environment, by means of which a visually observed image of an optically invisible mark is obtained in the form of a difference in structures (formed by particles of the stable phase of the meta-stable environment) on parts of the surface of the object in question with a different surface energy (i.e. on the parts, that are functionally "nucleation centers" of the stabilization of the phase of said meta-stable environment).

It should be noted, that the surface energy determines the work of forming the "nucleation centers" of a new phase and the energy of the phase transformation activation process. The existence of surface energy and surface tension lies at the root of meta-stable states (i.e. states of supercooling, superheating). Moreover, unlike the surface tension, the surface energy depends only minimally on the temperature.

As a meta-stable environment, usually supercooled vapor is used (for example, obtained from water vapor from the surrounding air by contacting it with the cooled object in question) or superheated liquid.

In case supercooled vapor is used as a meta-stable environment, an image of structures, which are formed by particles of a stable phase of the meta-stable environment, is obtained as drops of liquid on the surface of the object in question.

In case superheated liquid is used as a meta-stable environment, the image of the structures, formed by particles of the stable phase of the meta-stable environment, is obtained in the form of gas bubbles on the surface of the object in question.

The surface of the object in question is made into a mirror in order to increase the contrast of the visualized marking image.

It should also be noted, that for increasing the contrast of the visually observed mage of the optically invisible mark a visualization mode can be used, in which the condition of "meta-stability" of the surrounding environment is fulfilled exclusively for the parts of the surface of the object in question that are being modified. As a consequence, the preparation requirements (in particular, regarding the processing purity class) of the surface of the object in question, where the optically invisible marking image is established. However, it should be noted, that for the last of the discussed cases, the visualization mode of the image of the optically invisible mark moves from a dynamic process to a more static one, for which it is necessary to provide thermal and/or baric stabilization of said process.

In that manner, the disclosed method is essentially based on the strong dependence of the formation dynamics at the surface of the object of the stable phase from the meta-stable environment from the value of the free surface energy. On parts of the surface with different surface energy the formation of the stable phase from the meta-stable environment takes place differently. In the method according to the invention on the parts that are modified by changing the surface energy a different formation dynamic of the stable phase leads to visualization of the structure of the surface parts, that form the optically invisible marking image. The mark is permanent, because the modification of the parts of the surface object by changing the surface energy, e.g. obtained by means of spatially modulated ion beams, leads to a stable (including under ambient conditions) change of the state and structure of the surface with a changed surface energy.

EMBODIMENT

Figure 2:
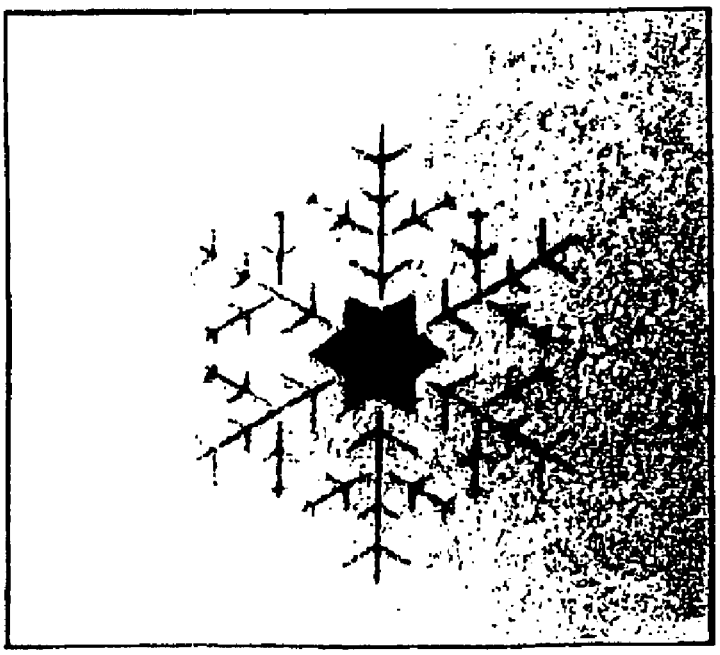
FIG. 2 shows the object in question after realization of visualization of the optically invisible marking image.

On the surface, polished to a class 13 purity, of a substrate (object in question) made of K-8 glass a hidden (optically invisible) marking image was formed in the shape of a snow-flake with a diameter of 6 mm, by modification of surface parts of the object by means of an ion beam passed through a stencil mask. For visualization of the optically invisible marking image the substrate was placed in the cooling chamber of a household refrigerator. Then the substrate was placed in the surrounding environment (corresponding with room conditions). As a result, the optically invisible (hidden) marking image (snow-flake) was visualized in the shape of drop of condensed water, distributed in a determined fashion on the surface of the object in question, as shown in FIG. 2 of the drawings, where the visually observed image of the snow-flake mark (formed form drop of condensed water) is shown at 7× magnification.

Tests, carded out in the course of one year with the initial mark (shown in FIG. 2), did not reveal any decrease in contrast of the mark after multiple visualizations in the course of the testing period. From the moment of creation of said mark the repeated application of the visualization process by means of the meta-stable environment does not transform the optically invisible marking image into a permanently visible one, as is the case, for example, in the prototype, following visualization of the optically invisible mark in a polymeric film by means of alkali etching.

INDUSTRIAL APPLICABILITY

Thus, the disclosed invention may be applied widely in various technical and scientific areas for writing and reading information is hidden from visual perception. It may in particular be used for repeated visualization of hidden images (marks) identifying an object, which images provide protection from unauthorized reproduction (forgery), as well as for purposes of scientific research in order to provide the visualization of optically invisible structures that differ only by the magnitude of the surface energy.

What is claimed is:

1. A method of creation and visualization of an optically invisible mark, according to which on the surface of a object in question an optically invisible image of a mark is formed by modifying at least one part of the surface, after which the visualization of that image is achieved, characterized in that the surface of the object in question is preliminarily made into a mirror, a modification is made by changing the surface energy of the modified parts, and visualization of optically invisible marking image is provided by means of creation, in the area of said surface of the object in question, of a meta-stable environment, by means of which a visually observed image of the optically invisible mark is achieved as difference in structures, formed by particles of the stable phase of the meta-stable environment, on the parts of the surface with different surface energy.

2. The method according to claim 1, characterized in that as a meta-stable environment supercooled vapor is used, and a structure image is obtained, which structures are formed by particles of stable phase of the meta-stable environment, in the form of drops of liquid on the surface of the object in question.

3. The method according to claim 1 or 2, characterized in that the meta-stable environment is obtained from water vapor of the surrounding air by cooling the object in question.

4. The method according to claim 1, characterized in that as a meta-stable environment superheated liquid is used and an image of structures is obtained, which are made of particles of the stable phase of the meta-stable environment in the form of gas bubbles on the surface of the object in question.

5. Method according to claim 1, characterized in that the surface of the object in question is made into a mirror by means of polishing.

6. Method according to claim 1, characterized in that the optically invisible marking image is obtained by means of a spatially modulated ion beam.

* * * * *